United States Patent [19]

Poletti

[11] Patent Number: 4,593,604

[45] Date of Patent: Jun. 10, 1986

[54] DRIVING DEVICE OF A ROTATING CYLINDER BLOCK OF A PUMP OR HYDRAULIC MOTOR

[75] Inventor: Henri Poletti, Bures sur Yvette, France

[73] Assignee: Regie Nationale des Usines Renault, Boulogne-Billancourt, France

[21] Appl. No.: 747,903

[22] Filed: Jun. 24, 1985

[30] Foreign Application Priority Data

Jun. 22, 1984 [FR] France ..... 84 09842

[51] Int. Cl.[4] ..... F01B 13/04; F04B 1/30

[52] U.S. Cl. ..... 91/504; 91/507

[58] Field of Search ..... 123/43 A, 43 AA; 91/504 L, 507, 499; 92/57

[56] References Cited

U.S. PATENT DOCUMENTS

| | | | |
|---|---|---|---|
| 3,589,244 | 6/1971 | Pruvot | 91/507 |
| 3,722,370 | 3/1973 | Aplin | 91/506 |
| 4,037,523 | 7/1977 | Eickmann | 92/58 |
| 4,466,338 | 8/1984 | Stoelzer | 91/506 |

FOREIGN PATENT DOCUMENTS

| | | | |
|---|---|---|---|
| 2619005 | 11/1977 | Fed. Rep. of Germany | 91/499 |

*Primary Examiner*—William L. Freeh

*Attorney, Agent, or Firm*—Oblon, Fisher, Spivak, McClelland & Maier

[57] ABSTRACT

Driving device of a rotating cylinder block (8) of a pump or hydraulic motor whose axis is inclined along an angle that is fixed or that can be adjusted in relation to the axis of rotation XX' of the drive shaft (1) and in which the transmission of the rotation torque from the drive shaft (1) to the cylinder block (8) (pump) and from the cylinder block (8) to the drive shaft (1) (motor) is performed by pistons (5) mounted by connecting ball joints (6) to a pulse plate (4) fixed in rotation with the drive shaft (1). The face (8*a*) of the cylinder block (8) turned toward the pulse plate (4) carries pairs of diametrically opposed projections (10) located at the entrance of the bores (7) of the cylinder block in which the pistons (5) move, which projections exhibit a concave surface (11) in contact with a surface of the ball joints (6) for connecting the pistons with the pulse plate (4). Applications is to motors and pumps having rotating cylinder blocks.

6 Claims, 2 Drawing Figures

DRIVING DEVICE OF A ROTATING CYLINDER BLOCK OF A PUMP OR HYDRAULIC MOTOR

BACKGROUND OF THE INVENTION

1. Field of the Invention

The invention relates to a driving device of a rotating cylinder block of a pump or a hydraulic motor, whose axis is inclined along an angle that is fixed or that can be adjusted in relation to the axis of rotation of the drive shaft and in which the transmission of the rotation torque from the drive shaft to the cylinder block (pump) and from the cylinder block to the drive shaft (motor) is performed by pistons mounted by connecting ball joints to an inclined plate fixed in rotation with the drive shaft.

2. Discussion of the Related Art

Several techniques are known for driving a cylinder block by pistons. According to a first embodiment disclosed by French Pat. No. 2,402,779, the piston rods are in contact with the walls of the various cylinders. According to another embodiment disclosed by French Pat. No. 2,252,481, the cylinder block is driven by a tapered zone separate from the fluid-tight zone of the piston.

SUMMARY OF THE INVENTION

The invention has as an object a homokinetic driving device for the cylinder block of a pump or a hydraulic motor of simplified design that assures high speed.

The invention has as another object a driving device of the cylinder block by ball joints of the pistons on a plate.

Another object of the invention is a cylinder block that rotates at high speed and is equipped with homokinetic driving means.

According to the invention, the face of the cylinder block turned toward the pulse plate carries diametrically opposed projections located at the entrance of the bores of the cylinder block. Each of the projections has a concave surface which can resiliently engage the ball joints for connecting the pistons with the inclined cylinder block.

The cylinder block partially covers, by its projections, the ball joints for connecting the pistons with the cylinder block and is driven by these same ball joints regardless of its operating angle of inclination $\alpha$.

BRIEF DESCRIPTION OF THE DRAWINGS

Other characteristics and advantages of the device will come out from the description of an embodiment of the device made with reference to the accompanying drawings in which.

DETAILED DESCRIPTION OF THE PREFERRED EMBODIMENT

Figure 1:
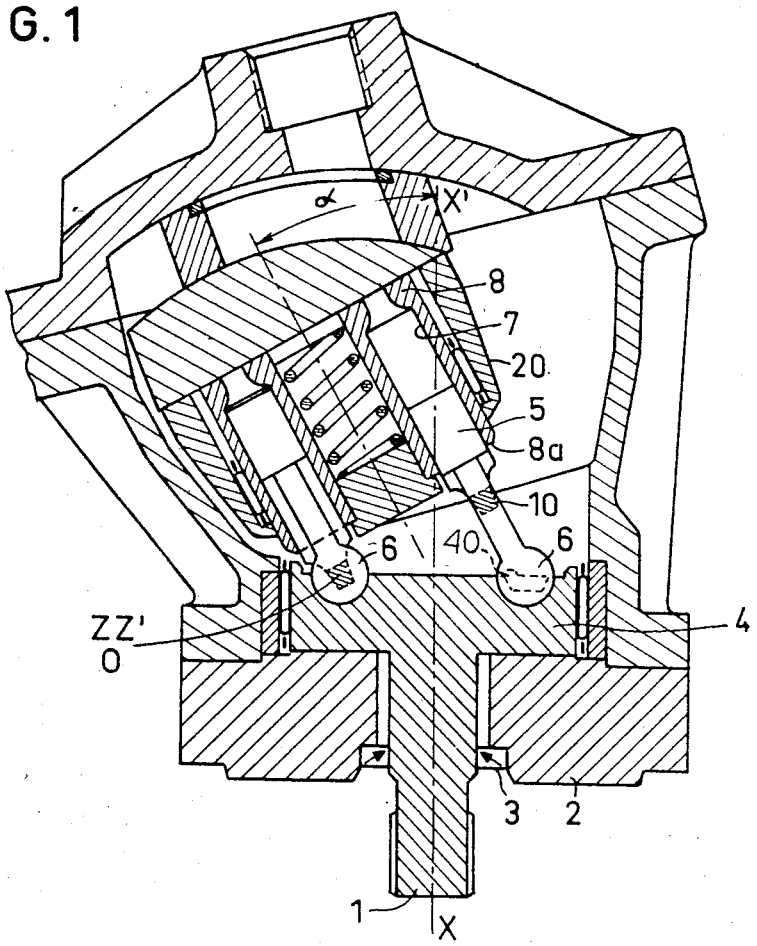
FIG. 1 is a diagrammatic view in section of a machine having axial pistons, where the axis of the cylinder block is inclined in relation to the axis of the drive shaft.

The hydraulic machine (pump or motor) shown in FIG. 1 possesses a drive a drive shaft 1, housed in a housing 2 and rotatable by a bearing 3. The shaft 1 carries a pulse plate 4 which is fixed thereto.

Pistons 5, numbering seven, are securely articulated on plate 4 by connecting ball joints 6. Pistons 5 are mounted so as to be axially movable in bores 7 of cylinder block 8 which is put in rotation by drive shaft 1 and by pulse plate 4. Appropriate means, not shown, are provided for conveying pumped or pumping fluid to or from the bores 7.

The axis of rotation of the cylinder block is inclined by an angle $\alpha$, this angle being fixed or adjustable from 0° to 30° in relation to axis XX' of shaft 1. Each of pistons 5 is mounted by a connecting ball joint 6 to the plate 4 as is well known.

Figure 2:
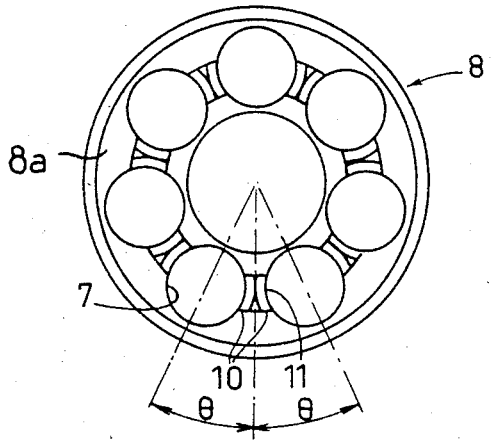
FIG. 2 is a view of the face of the cylinder block carrying the driving projections.

According to the invention, face 8a of cylinder block 8, which is turned toward pulse plate 4, carries pairs of diametrically opposed driving projections 10 located at the entrance of each of the openings of bores 7. The projections such as 10, better shown in FIG. 2, possess a concave surface 11 which can contact and resiliently engage the corresponding surface of ball joint 6 to form a simple driving means for the cylinder block. That is, the engagement of the projections 10 with a corresponding ball joint 6 drives the cylinder block 8 via the shaft 1, the plate 4, the ball 6 and the projections 10. Pulse plate 4 possesses diametrically opposed countersinkings on the edge of each ball joint housing to facilitate permitting projections 10 to contact the corresponding ball joint 6.

The centering of the cylinder block in a given inclination, which causes the travel of various pistons 5 to vary, is provided by a non-rotating carrier cage 20 hinged on housing 2 by the ball joints and projections 10 at the intersection of the plane of the centers of ball joints 6 and the plane passing through the centers of projections 10.

The angle of inclination $\alpha$ of the axis of rotation of the block 8 is taken in relation to axis XX' of the drive shaft. The angular offset angle $\theta$ of ball joint 6 centers is taken in relation to the axis of the dead centers (separation of zones HP and BP). It is seen that as the cylinder block is put into rotation and angle $\alpha$ is maximum, projections 10 will by turns leave or approach ball joints 6 in a stationary zone at intervals of approximately 52° (angle $\theta = \pm 26°$; when the machine has 7 pistons).

During the rotation of the cylinder block, each of the pistons successively occupies a position of maximum penetration in its bore, or top dead center position, in which a respective projection 10 of the cylinder block is in contact with ball joint 6 of a given piston.

During the rotation of the cylinder block 8, the various projections 10 at the entrance of the bores 7 gradually and successively approach ball joints 6 until corresponding piston 5 occupies a top dead center position in the top of bore 7. In this position, shown in FIG. 1, the contact surface between a projection 10 and a ball joint 6 is maximal and the volume of compressed oil maintained at the top of bore 7 is minimal and constant during the variation of the inclination of the cylinder block due to the fact that axis of articulation ZZ' of the cylinder block passes through center 0 of ball joint 6 that instantaneously occupies the top dead center position.

It should also be noted that the driving mode of the cylinder block according to the invention allows the elimination of the conventional driving connecting rod and that the projections 10 provide the homokinetic driving of the cylinder block regardless of its inclination.

The surface of the projections can be obtained by local deformation of the cylinder block before any surface processing and can be made from a machinable surface by conventional processes and mounted in the form of a cup on face 8*a* of the cylinder block by any known connecting means.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a pump/motor having a cylinder block rotatable about a fixed first axis, means for driving said cylinder block, comprising:

a drive shaft rotatable about a second axis, said first and second axes being offset from one another;

a pulse plate mounted on one end of said drive shaft;

at least two pumping cylinders in said cylinder block;

pistons reciprocably movable in said pumping cylinders;

ball joint means connected to said pistons and articulated to said pulse plate; and pairs of diametrically opposed projections fixed to said cylinder block and extending toward said pulse plate, said projections including means for resiliently engaging balls of said ball joint means, whereby upon rotation of said cylinder block and pistons, said pairs of projections sequentially engage and hold said balls so that cylinder block is sequentially articulated to said pulse plate at each of said balls.

2. The pump/motor of claim 1, including recesses in said pulse plate into which said projections can enter.

3. The pump/motor of claim 1, including means for adjusting an angle of offset between said first and second axes.

4. The pump/motor of claim 1 wherein said means for resiliently engaging comprise concave surfaces of said projections.

5. The pump/motor of claim 1, wherein said pulse plate has a surface facing said cylinder block, each said ball joint including a ball connected to one of said cylinders and held in a socket in said surface.

6. The pump/motor of claim 5 including seven of said pump cylinders.

* * * * *